US008001624B1

(12) United States Patent
Leedom

(10) Patent No.: US 8,001,624 B1
(45) Date of Patent: Aug. 23, 2011

(54) REMOVABLE HUNTER KNIT LINER FOR USE WITH A PROTECTIVE HELMET

(76) Inventor: Dennis Leedom, Duxbury, MA (US)

( * ) Notice: Subject to any disclaimer, the term of this patent is extended or adjusted under 35 U.S.C. 154(b) by 881 days.

(21) Appl. No.: 12/011,297

(22) Filed: Jan. 25, 2008

(51) Int. Cl.
*A42B 3/10* (2006.01)

(52) U.S. Cl. ..... 2/425; 2/172; 2/410; 2/423; 2/424

(58) Field of Classification Search ..... 2/455, 410, 2/423–425, 9, 172
See application file for complete search history.

(56) References Cited

U.S. PATENT DOCUMENTS

| | | | | |
|---|---|---|---|---|
| 3,055,012 | A * | 9/1962 | Aileo | 2/410 |
| 3,518,701 | A * | 7/1970 | Joseph | 2/172 |
| 4,321,433 | A | 3/1982 | King | 455/344 |
| 4,397,045 | A * | 8/1983 | Schonwetter et al. | 2/5 |
| 4,951,319 | A * | 8/1990 | Phillips et al. | 2/172 |
| 5,044,016 | A | 9/1991 | Coombs | 414/416 |
| 5,079,780 | A | 1/1992 | Coombs et al. | 420/421 |
| 5,517,698 | A | 5/1996 | Nault et al. | 424/425 |
| 5,575,009 | A * | 11/1996 | Ryvin | 2/173 |
| 5,915,537 | A * | 6/1999 | Dallas et al. | 2/410 |
| 6,009,562 | A | 1/2000 | Bullock et al. | 422/12 |
| 6,305,029 | B1 * | 10/2001 | Reynolds | 2/422 |
| 6,711,751 | B1 | 3/2004 | Muskovitz | 410/10 |
| 6,843,630 | B2 | 1/2005 | Sbongk | 411/508 |
| 6,996,852 | B1 * | 2/2006 | Cabrera | 2/172 |
| 7,043,761 | B2 * | 5/2006 | Epling | 2/7 |
| 7,096,512 | B2 * | 8/2006 | Blair | 2/410 |
| 2002/0120978 | A1 | 9/2002 | Moore | 412/412 |
| 2002/0148081 | A1 | 10/2002 | Ide | 324/324 |
| 2003/0192110 | A1 | 10/2003 | Dennis et al. | 416/416 |
| 2004/0034903 | A1 * | 2/2004 | Blair | 2/411 |
| 2004/0148743 | A1 | 8/2004 | Brunt | 132/132 |
| 2004/0204208 | A1 | 10/2004 | Thompson | 455/575 |
| 2005/0050617 | A1 | 3/2005 | Moore et al. | 410/410 |
| 2009/0241239 | A1 * | 10/2009 | Reynolds | 2/172 |

* cited by examiner

*Primary Examiner* — Christopher Harmon
(74) *Attorney, Agent, or Firm* — Janine D. Geraigery; Law Offices of J.D. Geraigery

(57) ABSTRACT

A winter liner system, including a hunter knit liner for wear underneath a protective helmet. The hunter knit liner fully encircles, and partially covers, the head of the wearer and includes a decorative exterior layer, an interior layer, and an interior foam layer sandwiched therebetween. The liner has two ear flaps extending downwardly to cover ears, and a looping band on each ear flap for holding the chinstrap of the helmet. At least one ear flap includes a side pocket integrated therein. The liner includes an elongated bill extending downwardly and horizontally across the front portion. The bill has an exterior surface which adheres directly to the front of the helmet. A plurality of snapping mechanisms, which include male snap heads embedded within the helmet and cooperating female snap receptacles integrated into the liner, removably securing the liner into the helmet.

20 Claims, 3 Drawing Sheets

REMOVABLE HUNTER KNIT LINER FOR USE WITH A PROTECTIVE HELMET

BACKGROUND OF THE INVENTION

1. Field of the Invention

This invention relates to helmets, and more particularly, to a removable hunter knit liner for coupling within a helmet and providing insulation, warmth, and comfort to the head, ears, cheeks and back of the neck.

2. Description of the Related Art

Protective helmets are worn by many persons who engage in various non-motorized recreational activities including, but not limited to, skiing, snowboarding, bicycling, skateboarding, and in-line skating. However, wearing a helmet alone does not provide sufficient warmth or protection from the elements, and wearing hats or earmuffs with a helmet impedes the helmet's ability to fit comfortably and provide proper protection in the event of an accident. This leaves the helmet-wearer either insufficiently protected from the elements if they do not wear additional garments, or uncomfortable and improperly protected from head injuries if they do. Moreover, some persons, particularly children, do not wear helmets at all during potentially dangerous recreational activities because standard helmets can be unfashionable and uncomfortable to wear. The current invention seeks to eliminate these problems entirely.

U.S. Pat. No. 5,517,698 to Thomas R. Nault; Vicki L. Nault, discloses a bicycle helmet having a rigid shell, including a polymeric shell liner. The shell liner arranged to selectively receive at least one liner strip employing hook and loop fastener structure to provide for adjustment of the rigid shell onto an individual. A removable chin guard and pivotal visor is mounted to the rigid shell, with the visor including a visor rib arranged for securement in a raised orientation, with the visor arranged for reception within a spring clip structure mounted to the rigid shell.

United States Pat. Application No. 20020120978 to Dan T. Moore, III, discloses a protective helmet is provided which preferably has a outer shell and an energy-absorbing liner. The liner is made of low resilience or slow-recovery viscoelastic foam which is compression rate sensitive.

U.S. Pat. No. 4,321,433 to Frederick T. King, discloses a helmet having a three-piece construction comprising a liner of soft, resilient material adapted to reside adjacent the head of the user, an intermediate shell which lies over the inner layer and which mounts component parts constituting a radio, transmitter or the like, and a protective outer shell which covers the electrical components. The outer shell and the intermediate shell are joined in snap-lock relationship to provide a waterproof seal to protect the electronic component parts.

U.S. Pat. No. 5,044,016 to Christopher E. Coombs; assigned to Cairns & Brother, Inc., discloses an improved protective helmet assembly including an outer shell and an inner impact attenuation liner assembly wherein a chinstrap assembly is mounted to the inner impact attenuation liner assembly and the inner impact attenuation liner assembly is mounted within the outer impact shell to detach under predetermined load conditions from the outer impact shell.

United States Pat. Application No. 20030192110 to Mike Dennis; Russell A. Monk; Bruce L. Thede, discloses a unitary helmet liner suspension structure which is designed for easy and quick and correct fit into differently sized helmet shells whose specific sizes reside within a known and defined range of such sizes.

U.S. Pat. No. 6,843,630 to Albert Sbongk; assigned to ITW Automotive Products GmbH & Co. KG, discloses a fastening clip has an annular portion and two legs extending therefrom, each leg having a locking element. Two identical clips can be fastened together with the locking elements securing against separation. The clips can be used to fasten a panel to opposite walls of an accommodating member by inserting the clips from opposite sides in aligned through bores formed in the panel and the opposite walls, and pushing the clips toward each other until the locking elements engage. The annular portions of the clips have shoulders engaging the panel, while the legs have resilient projections engaging a surface of the through bore of the panel. The legs of each clip are barb-shaped and have distal ends snuggly fitted in spaces formed in the annular portion between the legs of the other clip.

United States Pat. Application No. 20020148081 to Thad Ide; David P. Halstead, discloses a buckle for receiving a strap member and for snap-fitting to a snap stud located on a helmet. The buckle includes a metal member having opposite ends, with an aperture located between the ends and a slit on either side of the aperture. Each of the slits including a plurality of rigorous surfaces suitable for frictionally engaging a strap member positionable therethrough.

United States Pat. Application No. 20040148743 to Anton Brunt; assigned to Strategic Sports Ltd., discloses a strap clamp for a helmet that includes relatively pivotable members which have internal wedge faces. Relative pivoting movement of the members releases the wedge faces to permit strap adjustment. In the preferred embodiment the pivotable members are identical, and snap-fitted together. Divergence of the straps on one side gives a degree of self-locking under tension.

United States Pat. Application No. 20040204208 to Spencer J. Thompson, discloses a sports helmet includes a liner comprised of impact resistant material and a protective shell encasing an outer surface of the liner. A female audio jack is secured within a rear cavity of the liner and has an aperture extending without the liner for receiving a male audio jack connected to a portable audio device. A pair of cavities is formed on opposite sides of the liner in which are secured speakers. Wiring extends from the female audio jack to the integral speakers. The speakers are positioned and oriented such so as to provide audio to the helmet wearer without blocking surrounding sound, and without affecting the safety aspects of the helmet.

United States Patent Application 20060060617 to Dan T. Moore, III; Kathleen M. Novak, discloses a helmet that is custom-fitted to a wearer's head, and methods of making the helmet, are provided. Method includes the steps of positioning a shape-forming means over the wearer's head, and hardening the shape-forming means to provide a hardened headform that substantially conforms to the shape of the wearer's head. The shape-forming means can be a stretchable beanie cap that is coated or impregnated with a curable polymeric material, a heat-softenable plastic sheet, or a strip or plurality of strips of curable tape that are wrapped about the wearer's head to provide a headwrap. Once the hardened headform has been made, it can be used to cast a hardened plaster fixture for use as the "male" member in a mold for casting an energy absorbing foam liner for a helmet which has an inner surface substantially conforming to the shape of the wearer's head. Alternatively, the hardened headform can itself be used as the "male" member of the liner casting mold.

U.S. Pat. No. 6,711,751, to David Todd Muskovitz; assigned to K-2 Corporation, discloses a helmet which includes a shell portion, a liner portion which is in the interior part of the helmet, and an insert portion which is embedded in the liner portion. The insert portion includes a mounting portion for one or more accessories, such as chin straps, side flaps, padding, and the like. The mounting liner provides structural integrity to the protective helmet, provides sufficient impact attenuation properties, and allows various items to be attached to the protective helmet, while still allowing the outer shell to be of lightweight construction. In one aspect, side portions about the ear are coupled to the insert portion. The side portions are rigid to provide support for side eyewear retaining portions that hold an eyewear elastic portion at the side of the helmet, thus preventing the eyewear from sliding off while resting atop the helmet.

U.S. Pat. No. 6,009,562, to Christopher Bullock; Michael Grim; Flint Thorne; assigned to Bell Sports, Inc., discloses a helmet and method of making the same for allowing repeated removal and attachment of helmet accessories, that includes an inner liner member for substantially covering a wearer's head, and an outer shell member that includes an upper shell surface, a lower shell surface which substantially covers an upper liner surface of the inner liner member, and at least one mounting hole formed therethrough. A grommet is disposed along the upper shell surface and aligned over the mounting hole. A receptacle housing is disposed along the lower shell surface and has a receptacle aligned to and facing the mounting hole. Engagement prongs secure the grommet to the receptacle housing with the shell member there between. The helmet accessory has at least one mounting member, such as a protrusion or screw. The receptacle includes a device for removably engaging the mounting member when the mounting member is inserted through the mounting hole in order to removably mount the helmet accessory to the helmet. An anchor member is connected to the receptacle housing and extends into the inner liner member to engage with a significant volume of the inner liner to secure the receptacle housing in place.

U.S. Pat. No. 5,079,780, to Christopher E. Coombs; Adolfo A. Ferreira; Scott J. Miller; assigned to Cairns & Brother, Inc., discloses a protective helmet assembly including an outer impact shell and an inner impact attenuation liner assembly wherein the inner liner assembly includes an adjustable headband assembly comprised of a front headband member and a rear spring-loaded headband member under the control of a chinstrap into a fitted configuration about the head of the user by a clip assembly. The inner impact attenuation liner assembly is mounted within the outer impact shell to separate therefrom under predetermined load conditions.

While these units may be suitable for the particular purpose employed, or for general use, they would not be as suitable for the purposes of the present invention as disclosed hereafter.

SUMMARY OF THE INVENTION

It is an object of the invention to provide a helmet liner that can couple within a plurality of different type helmets. Accordingly, the hunter knit liner has a plurality of snapping mechanisms that are suitable for integration with standard helmets. Additional methods of coupling may include, but are not limited to, hook and loop fasteners, buttons, and zippers.

It is another object of the invention to provide a means for easily attaching and detaching the hunter knit liner from the helmet in case of changing weather conditions. Accordingly, the hunter knit liner is coupled to the helmet via a snapping mechanism, by a plurality of male snap heads coupled to the helmet, fastening with a plurality of female snap receptacles secured to the interior surface of the helmet.

It is an object of the invention to provide comfort and warmth to the wearer of a helmet. Accordingly, the hunter knit liner features an exterior layer of decorative fleece material, an interior layer faux fur, and a layer of foam sandwiched between the two layers for extra insulation.

It is another object of the invention to provide a fashionable helmet, thus promoting helmet use and making cold weather sports safer. Accordingly, the hunter knit liner comes in a variety of aesthetically pleasing designs.

It is another object of the invention to prevent bunching of the hunter knit liner during use. Accordingly, the hunter knit liner includes one continuous band having elongated strips of male hook and loop fastener coupled thereto for attaching directly to the interior surface of the helmet.

It is another object of the invention to provide a means for protecting the wearer's ears from cold and inclement weather conditions. Accordingly, the hunter knit liner includes downwardly extending ear flaps from the continuous band for insulating the ears and side of the face from freezing temperatures and whipping wind.

It is another object of the invention to provide a means to keep the forehead warm. Accordingly, the hunter knit liner includes an elongated bill that extends downwardly from the front portion of the continuous band. The bill is held in an upward position via an elongated strip of female hook and loop fastener attached thereto which adheres directly to the elongated strip of male hook and loop fastener on the exterior surface of the front of the helmet.

It is another object of the invention to provide an easily accessible pocket in which small valuables such as an MP3 player can be stored and kept safe. Accordingly, a side pocket with a closure flap is coupled to at least one of the ear flaps. The side pocket is positioned so that the chinstrap of the helmet runs over the pocket, securing it closed.

It is another object of the invention to keep the ear flaps in proper position over the ears. Accordingly, a looping band is coupled to the exterior of both ear flaps. The looping band accepts the chinstrap therethrough and holds the ear flaps snugly in place.

It is another object of the invention to make the wearing of the chinstrap more comfortable. Accordingly, the ear flaps prevent a barrier between the chinstrap and the skin, preventing rubbing and chafing.

It is another object of the invention to provide a means for protecting the wearer's neck from harsh weather conditions. Accordingly, a back portion extends downwardly from the continuous band to keep the neck warm and provide a barrier again rain or snow.

It is another object of the invention to provide proper ventilation for the head of the wearer.

Accordingly, the top of the hunter knit liner is left open, allowing for airflow through ventilation ports on the top and rear of the helmet.

It is another object of the invention to provide extra warmth to the top of the head of the wearer if necessary. Accordingly, a beanie may be attached to the continuous band of the hunter knit liner to fully enclose the head and provide insulation.

It is another object of the invention to provide a means for the wearer to enjoy audio stimulation while engaging in an activity. Accordingly, a pair of audio speakers are able to be embedded in the ear flaps of the hunter knit liner. A jack in the ear flaps allows the connection of a radio, compact disc player, or MP3 player to the speaker system.

This invention is a winter liner system, including a hunter knit liner for wear underneath a protective helmet. The hunter knit liner fully encircles, and partially covers, the head of the wearer and includes a decorative exterior layer, an interior layer, and an interior foam layer sandwiched therebetween. The liner has two ear flaps extending downwardly to cover ears, and a looping band on each ear flap for holding the chinstrap of the helmet. At least one ear flap includes a side pocket integrated therein. The liner includes an elongated bill extending downwardly and horizontally across the front portion. The bill has an exterior surface which adheres directly to the front of the helmet. A plurality of snapping mechanisms, which include male snap heads embedded within the helmet and cooperating female snap receptacles integrated into the liner, removably securing the liner into the helmet.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
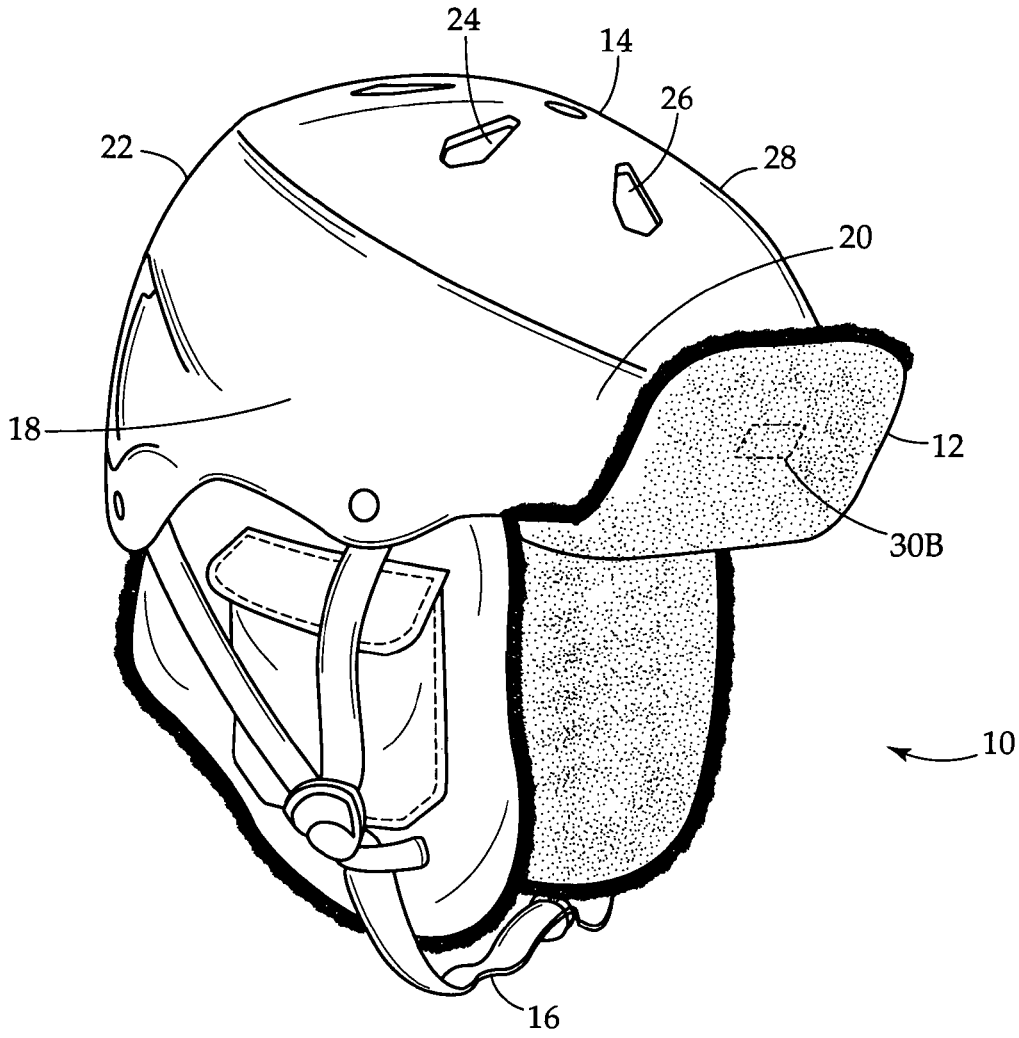
FIG. 1 is a diagrammatic perspective view of a removable hunter knit liner of the present invention for coupling within a helmet.

FIG. 1 illustrates a winter liner system 10 having a removable hunter knit liner 12 for coupling into a helmet 14. The interchangeable hunter knit liner 12 is usable in various non-motorized recreational activities including, but not limited to, skiing, snowboarding, bicycle riding, skateboarding and in-line skating. The hunter knit liner 12 is suitable for use primarily in the winter season, preferably, in cold weather climates. The hunter knit liner 12 is capable of covering the head, neck, and ears of the wearer. Preferably, the hunter knit liner 12 is composed of water repellant materials, wool knit materials, fleece, cotton knit material, polymer knit materials, animal fur, faux fur, or a combination thereof.

The present invention contemplates the hunter knit liner 12 removably coupling to a plurality of different type helmets 14, by a plurality of different methods. Preferably, the hunter knit liner 12 is attachable within the helmet 14 by a plurality of snapping mechanisms 60, suitable for integration with standard helmets 14. Other methods of coupling include, but are not limited to, hook and loop fasteners, buttons, zippers and other like coupling mechanisms.

Preferably, the helmet 14 is of the variety commonly found in the marketplace. The helmet 14 includes a protective shell, or zipmold casing, and includes an integrally coupled chinstrap 16 for securing the helmet 14 to the head of the wearer. The helmet 14 includes two sides 18, a front 20 and a back 22, and may also include a variety of additional components, including but not limited to, a goggle clip and air vents 24. The air vents 24 extend between the interior surface 26 and exterior surface 28 of the helmet 14.

Figure 2:
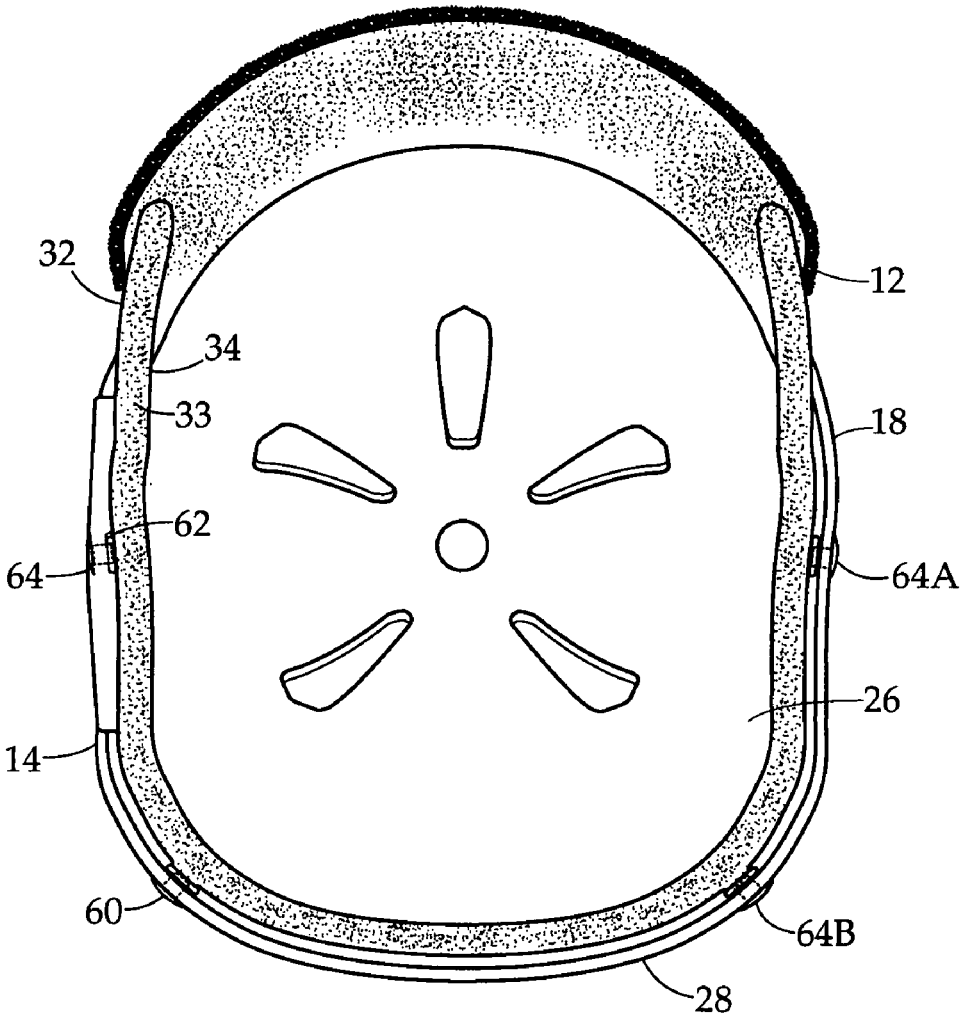
FIG. 2 is a plan view of the helmet of the present invention having an interior surface having a plurality of snap receptacles integrally coupled thereto for fastening the hunter knit liner therein.

FIG. 2 illustrates the helmet 14 having an interior surface 26 and an exterior surface 28. The hunter knit liner 12 is secured to the interior surface 26 of the helmet 14 via a snapping mechanism 60. In its broadest context, the snapping mechanism 60 consists of a male snap head 64 insertable into a cooperating female snap receptacle 62. Preferably, at least four male snap heads 64 are embedded within the interior surface 26 of the helmet 14. Preferably, the first two male snap heads 64A are positionable on each side 18 of the helmet 14 near the temples of the wearer, and the second two male snap heads 64B are positionable on each side 18 of the helmet 14 behind the ears and adjacent the neck. At least four female snap receptacles 62 are permanently integrated within the continuous band 41 of the hunter knit liner 12 and properly positioned so as to align with corresponding male snap heads 64 when the hunter knit liner 12 is fastened within the helmet 14.

In addition, the exterior surface 28 of the helmet 14, at the front 20, includes an elongate strip of male hook and loop fastener 30B coupled thereto by adhesion, or other like method. Here the elongated strip of male hook and loop fastener 30B interlocks with corresponding female hook and loop fasteners 51 on the exterior 32 of the hunter knit liner 12. In addition, depending on the material chosen, the exterior layer 32 of the hunter knit liner 12 can adhere directly to the elongated strip of male hook and loop fastener 30B.

Figure 3:
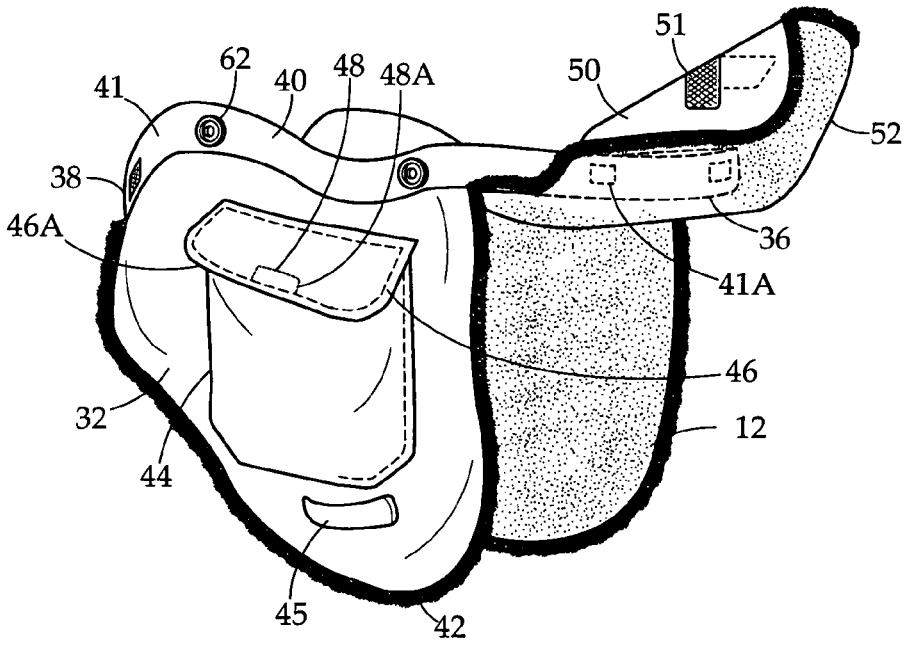
FIG. 3 is a diagrammatic perspective view of the hunter knit liner of the present invention which removably couples into a helmet via snaps shown, the liner also one continuous band having ear flaps, wherein at least one ear flap has a side pocket, looping bands for holding chinstraps in place, and a bill extending downwardly from the front of the band.

FIG. 3 illustrates the hunter knit liner 12 of the present invention. The hunter knit liner 12 is a partial coverage winter liner for providing both warmth and comfort to the wearer. The hunter knit liner 12 includes one continuous band 41 that fully encircles the head of the wearer. The continuous band 41 includes a front portion 36. Underneath the band 41, the hunter knit liner 12 includes a back portion 38 integrally coupled between two side portions 40, having an exterior layer 32 and an interior layer 34. The hunter knit liner 12 fully encircles the head defining the one continuous band 41 and offers coverage at the forehead by the front portion 36, at the top of the neck by the back portion 38 and at the sides of the head by two side portions 40, while the top of the head is left exposed. In other embodiments, it is contemplated that the one continuous band 41 is coupled directly to a beanie for fully enclosing and insulating the top of the head. In the preferred embodiment, the continuous band 41 includes at least one elongated strip of male hook and loop fastener 41A attached thereto for further securing the hunter knit liner 12 into the helmet 14. Preferably, there are three elongated strips of male hook and loop fastener 41A coupled to the continuous band 41. One of the elongated strips of male hook and loop fastener 41A is coupled to the band 41 at the back portion 41 of the hunter knit liner 12, and two elongated strips of male hook and loop fastener 41A are spaced apart and coupled to the front portion 36 of the continuous band 41. Here, the elongated strips of the male hook and loop fastener 41A attach directly to the material of the interior surface 26 of the helmet 14. This prevents the hunter knit liner 12 from bunching and gathering within the helmet 14 during use. Furthermore, this allows the hunter knit liner 12 to lay flat within the helmet 14 and conform to the head of the wearer for additional comfort and ease of use.

Two ear flaps 42 extend downwardly along each side portion 40 from the continuous band 41 of the hunter knit liner 12 for completely covering the ears of the wearer. A side pocket 44 is coupled to the exterior layer 32 of the hunter knit liner 12 on at least one of the ear flaps 42. The side pocket 44 is advantageous for holding items therein, including MPEG-1 audio layer 3 (MP3) players and the like. As shown in FIG. 3, the side pocket 44 is substantially square and includes a closure flap 46 for securing the contents within the side pocket 44. The closure flap 46 has an underside 46A which preferably includes a fastening means 48 for securing the closure flap 46. Preferably, the fastening means 48 is a hook and loop fastener 48A, but in alternate embodiments can be a snap closure or any other like method.

Further, a looping band 45 is coupled to the exterior layer 32 of each ear flap 42. Preferably the looping band 45 is positioned below the side pocket 44 of the ear flap 42 containing the side pocket 44. The looping band 45 accepts the chinstraps 16 therethrough and holds the ear flaps 42 in position over ears of the wearer, by preventing the chinstrap from shifting around.

An elongated bill 50 extends downwardly from the continuous band 41 and horizontally across the front portion 36 of the continuous band 41 of the hunter knit liner 12. The bill 50 is only connected to the side portions 40 and ear flaps 42 by means of the one continuous band 41. But for said continuous band 41, the bill 50 and the ear flaps 42 would not be connected. The bill 50 has an exterior surface 52, which preferably couples adjacent the exterior surface 28 of the helmet 14, such that the bill is held in an upward position during use. The bill 50 is advantageous for insulating and keeping warm the forehead of the wearer. Preferably, the exterior surface 52 of the bill 50 of the hunter knit liner 12 includes an elongated strip of female hook and loop fastener 51 which adheres directly to the elongated strip of male hook and loop fastener 30B coupled to the exterior surface 28 at the front 20 of the helmet 14. Alternatively, the material of the exterior layer 52 of the bill 50 of the hunter knit liner 12 can adhere directly to the elongated strip of male hook and loop fastener 30B found on the exterior surface 28 of the helmet 14.

In the preferred embodiment, the exterior layer 32 of the hunter knit liner 12 is made of decorative fleece material. The interior layer 34 of the hunter knit 12 is made of faux fur material for additional warmth and comfort. The hunter knit liner 12 also includes an interior foam layer 33 which is sandwiched between the exterior and interior layers 32 and 34. The exterior and interior layers 32 and 34 are sewn together or coupled together by any similar method, and securely hold the interior foam layer 33 therebetween. The interior foam layer 33 provides insulation, warmth and additional durability to the hunter knit liner 12.

When the hunter knit liner 12 is worn underneath the helmet 14, the continuous band 41 encircles the wear's head and the ear flaps 42 extend below the helmet 14 along the sides of the face of the wearer, so as to cover the ears of the wearer and protect the wearer from the elements, including frostbite. The back portion 38 of the hunter knit liner 12 also extends downwardly covering the back of the neck of the user from the elements, when worn. While the pair of ear flaps 42 insulate and protect the ears and sides of the neck, the back portion 38 protects and insulate the neck of the wearer in cold temperatures.

The hunter knit liner 12 can be worn alone as a hat or cover-up, or together underneath the helmet 14, as preferred by the wearer.

In additional embodiments, a pair of audio speakers are embedded within each ear flap 42 of the hunter knit liner 12. An opening in each of the ear flaps provides access to a jack which allows for insertion of a plug from an entertainment device such as a radio, compact disc player, or MP3 player. This allows the wearer of the hunter knit liner 12 to easily interface their device with the speaker within hunter knit liner 12 and enjoy audio stimulation while engaging in an activity.

In use, a user can purchase one helmet 14 and a hunter knit liner 12. Depending on the weather conditions and activity a user can selectively wear the hunter knit liner 12 within the helmet 14, or alone without the helmet 14, and can alternate or change between the two as desired. In addition, a plurality of additional size and shaped hunter knit liners 12 are contemplated, including different areas of coverage, material, and decorative design.

In conclusion, herein is presented a hunter knit liner for use with a protective helmet for use in non-motorized activities. The invention is illustrated by example in the drawing figures, and throughout the written description. It should be understood that numerous variations are possible, while adhering to the inventive concept. Such variations are contemplated as being part of the invention.

The invention claimed is:

1. A winter liner system, comprising:

a protective helmet having an interior surface having a plurality of male snap heads embedded therein, an exterior surface, a front, a back, and two sides between said front and said back, said exterior surface at said front of said helmet including an elongate strip of male hook and loop fastener coupled thereto by adhesion, and said helmet having an integrally coupled chinstrap for securing said helmet to the head of the wearer;

a hunter knit liner including one continuous band having a front portion, underneath said continuous band said liner having a back portion integrally coupled between two side portions, said back and two side portions having an exterior layer, an interior layer and an interior foam layer sandwiched between said exterior and interior layers, said hunter knit liner having two ear flaps extending downwardly from said continuous band along said side portions below said helmet to cover ears, sides of the face and cheeks of the wearer, said hunter knit liner having a substantially square side pocket coupled to said exterior layer of said hunter knit liner on at least one of said ear flaps, said side pocket including a closure flap, said hunter knit liner having a looping band coupled to said exterior layer of each ear flap for accepting said chinstraps therethrough, said hunter knit liner including an elongated bill extending downwardly from said continuous band and horizontally across said front portion of said continuous band, said bill having an exterior surface which adheres directly to the elongated strip of the male hook and loop fastener on the front of the helmet such that said bill is held in an upward position during use, and said liner fully encircling the head of the wearer at the forehead by said bill at the top of the neck by said back portion and at sides of the head by said two side portions; and a plurality of snapping mechanisms on said continuous band for removably securing said hunter knit liner to said interior surface of said helmet, said snapping mechanisms including at least one female snap receptacle insertable into said cooperating male snap head of said helmet.

2. A winter liner system of claim 1, further comprising a helmet having a goggle clip, and a plurality of air vents.

3. A winter liner system of claim 1, further comprising at least one elongated strip of male hook and loop fastener attached to the continuous band for further securing the hunter knit liner to the interior surface of the helmet.

4. A winter liner system of claim 1, wherein at least four male snap heads are embedded within the interior surface of the helmet, the first two male snap heads positionable on each side of the helmet near the temples of the wearer, and the second two male snap heads positionable on each side of the helmet behind the ears and adjacent the neck.

5. A winter liner system of claim 4, wherein at least four female snap receptacles are permanently integrated within said continuous band of said hunter knit liner properly positionable to align with corresponding male snap heads of the helmet when the hunter knit liner is fastened within the helmet.

6. A winter liner system of claim 1, wherein said exterior surface of said bill has an elongated strip of female hook and loop fastener which adheres directly to said elongated strip of male hook and loop fastener along said exterior surface of said front of said helmet.

7. A winter liner system of claim 1, wherein said side pocket includes a closure flap having an underside including a fastening means, wherein said fastening means is a hook and loop fastener.

8. A winter liner system of claim 1, wherein the exterior layer of the hunter knit is made of decorative fleece material.

9. A winter liner system of claim 1, wherein the interior layer of the hunter knit is made of faux fur material for additional warmth and comfort.

10. A winter liner system, comprising:

a protective helmet having an interior surface having at least four male snap heads embedded therein, an exterior surface, a front, a back, and two sides between said front and said back, said helmet having an integrally coupled chinstrap for securing said helmet to the head of the wearer, said first two male snap heads positionable on each side of the helmet near temples of the wearer, and said second two male snap heads positionable on each side of said helmet behind the ears and adjacent the neck, said exterior surface at said front of said helmet including an elongate strip of male hook and loop fastener coupled thereto by adhesion, and a plurality of air vents extending between said interior and exterior surface; and a hunter knit liner including one continuous band having a front portion, underneath said continuous band said liner having a back portion integrally coupled between two side portions, said back and two side portions having an exterior layer, an interior layer and an interior foam layer sandwiched between said exterior and interior layers, said hunter knit liner having two ear flaps extending downwardly from said continuous band along said side portions below said helmet to cover ears, sides of the face and cheeks of the wearer, said hunter knit liner having a substantially square side pocket coupled to said exterior layer of said hunter knit liner on at least one of said ear flaps, said side pocket including a closure flap, said hunter knit liner having a looping band coupled to said exterior layer of each ear flap for accepting said chinstraps therethrough, said hunter knit liner including an elongated bill extending downwardly from said continuous band and horizontally across said front portion of said continuous band, said bill has an exterior surface having a strip of female hook and loop fastener which adheres directly to said elongated strip of male hook and loop fastener along said exterior surface of said front of said helmet, such that said bill is held in an upward position during use, said continuous band having at least one elongated strip of male hook and loop fastener coupled thereto for holding said hunter knit liner to said interior surface of said helmet, and said liner fully encircling the head of the wearer at the forehead by said bill at the top of the neck by said back portion and at sides of the head by said two side portions;

a plurality of snapping mechanisms on said continuous band for removably securing said hunter knit liner to said interior surface of said helmet, said snapping mechanisms including at least four female snap receptacles permanently integrated within said continuous band of said hunter knit liner properly positionable to insert with said corresponding four male snap heads of said helmet when said hunter knit liner is inserted within said helmet.

11. A winter liner system of claim 10, further comprising a helmet having a goggle clip.

12. A winter liner system of claim 10, wherein said side pocket includes a closure flap having an underside including a fastening means, wherein said fastening means is a hook and loop fastener.

13. A winter liner system of claim 10, wherein the exterior layer of the hunter knit is made of decorative fleece material.

14. A winter liner system of claim 10, wherein the interior layer of the hunter knit is made of faux fur material for additional warmth and comfort.

15. A winter liner system of claim 10, wherein three elongated strips of male hook and loop fastener couple to the continuous band, wherein one of the elongated strips of male hook and loop fastener is coupled to the continuous band at said back portion of said liner, and two elongated strips of male hook and loop fastener are spaced apart and coupled to said front portion of said continuous band.

16. A winter liner for wear under a protective helmet having an interior surface having a plurality of male snap heads embedded therein, an exterior surface, a front, a back, and two sides between said front and said back, said exterior surface at said front of said helmet including a second elongate strip of male hook and loop fastener coupled thereto by adhesion, and said helmet having an integrally coupled chinstrap for securing said helmet to the head of the wearer, comprising:

a decorative hunter knit liner including one continuous band having a front portion, underneath said continuous band said liner having a back portion integrally coupled between two side portions, said back and two side portions having an exterior layer, an interior layer and an interior foam layer sandwiched between said exterior and interior layers, said hunter knit liner having two ear flaps extending downwardly from said continuous band along said side portions below said helmet to cover ears, sides of the face and cheeks of the wearer, said hunter knit liner having a substantially square side pocket coupled to said exterior layer of said hunter knit liner on at least one of said ear flaps, said side pocket including a closure flap, said hunter knit liner having a looping band coupled to said exterior layer of each ear flap for accepting said chinstraps therethrough, said hunter knit liner including an elongated bill extending downwardly from said continuous band and horizontally across said front portion of said continuous band, said bill having an exterior surface which adheres directly to the elongated strip of the male hook and loop fastener on the front of the helmet, such that said bill is held in an upward position during use, said continuous band having at least one elongated strip of male hook and loop fastener coupled thereto for holding said hunter knit liner to said interior surface of said helmet, said continuous band having at least one female snap receptacle for securing into said male snap head of said helmet, and said liner fully encircling the head of the wearer at the forehead by said bill at the top of the neck by said back portion and at sides of the head by said two side portions.

17. A winter liner of claim 16, wherein said side pocket includes a closure flap having an underside including a fastening means, wherein said fastening means is a hook and loop fastener.

18. A winter liner of claim 16, wherein said exterior surface of said bill has a strip of female hook and loop fastener which adheres directly to said elongated strip of male hook and loop fastener along said exterior surface of said front of said helmet.

19. A winter liner of claim 16, wherein the exterior layer of the hunter knit is made of decorative fleece material, and the interior layer of the hunter knit is made of faux fur material for additional warmth and comfort.

20. A winter liner system of claim 16, wherein three elongated strips of male hook and loop fastener couple to the continuous band, wherein one of the elongated strips of male hook and loop fastener is coupled to the continuous band at said back portion of said liner, and two elongated strips of male hook and loop fastener are spaced apart and coupled to said front portion of said continuous band.

* * * * *